US006050370A

United States Patent [19]

Jung

[11] Patent Number: 6,050,370

[45] Date of Patent: Apr. 18, 2000

[54] GUIDE ROLLER APPARATUS FOR ELEVATOR SYSTEM

[75] Inventor: Jong Hyuk Jung, Seoul, Rep. of Korea

[73] Assignee: LG Industrial Systems, Co., Ltd., Seoul, Rep. of Korea

[21] Appl. No.: 09/001,105

[22] Filed: Dec. 30, 1997

[30] Foreign Application Priority Data

Dec. 30, 1996 [KR] Rep. of Korea ..... 96-77555
Aug. 30, 1997 [KR] Rep. of Korea ..... 97-44051

[51] Int. Cl.[7] ..... B66B 7/04
[52] U.S. Cl. ..... 187/410; 187/409
[58] Field of Search ..... 187/409, 410

[56] References Cited

U.S. PATENT DOCUMENTS 3,669,222 6/1972 Takamura et al. ..... 187/410
5,581,844 12/1996 Raheb et al. ..... 16/82 X
5,632,358 5/1997 Maeda et al. ..... 187/410

FOREIGN PATENT DOCUMENTS 352009246 1/1977 Japan ..... 187/410
404313584 11/1992 Japan ..... 187/410
405246661 9/1993 Japan ..... 187/410

*Primary Examiner*—Joseph E. Valenza
*Assistant Examiner*—Gene O. Crawford
*Attorney, Agent, or Firm*—Birch, Stewart, Kolasch & Birch, LLP

[57] ABSTRACT

A guide roller apparatus for an elevator system includes a flat frame for fixing to each corner of the elevator car, and a lever having a lower portion hingedly connected to an upper portion of the frame and an upper portion rotatably connected to a roller shaft of the guide roller, with an insertion hole being formed through amid portion of the lever. A vertical plate is connected to an end portion f the frame and faces the lever. An elastic support member is connected between an upper portion of the lever and an upper portion of the vertical plate. A control device has an end portion connected to a mid inner portion of the vertical plate, and another end portion passed through the insertion hole formed in the lever. An elastic medium member is disposed on the control device between the vertical plate and the lever.

4 Claims, 7 Drawing Sheets

GUIDE ROLLER APPARATUS FOR ELEVATOR SYSTEM

BACKGROUND OF THE INVENTION

1. Field of the Invention

The present invention relates to an elevator system, and more particularly to an improved guide roller apparatus for an elevator system for preventing an elevator car from shaking horizontally during an operation of the elevator system by transformations of guide rails disposed vertically along side walls in an elevation shaft.

2. Description of the Background Art

As shown in FIG. 1, in a general elevator system, an elevator car 1 for carrying passengers or luggage is suspended by a plurality of ropes 2 engaged at a top portion thereof. The ropes 2 are connected to a driving apparatus (not shown) which allows the elevator car 1 to move vertically in an elevator shaft 3. Here, the driving apparatus (not shown) is disposed at an upper portion of a building equipped with the elevator system.

A plurality of guide rails 4 for guiding the elevator car 1 are vertically fixed along sidewalls of the elevator shaft 3. A plurality of guide rollers 5 running along the guide rails 4 are engaged to a frame (not shown) fixed to each corner the elevator car 1.

The mechanism of the guide rollers 5 will now be described with reference to the accompanying drawings.

As shown in FIGS. 2A–2C and C, the conventional guide roller apparatus includes a lever 7 having a lower portion hingedly engaged to a flat type frame 6 fixed to each corner of the elevator car 1, and an upper portion connected to a rotation shaft 5*a* of the guide roller 5, thereby supporting the guide roller 5 on the rotation shaft 5*a*. Here, an insertion hole 7*a* is formed at a lower portion of the lever 7.

A side end portion of the frame 6 there is engaged a vertical plate 10 facing against the lever 7 and having a predetermined height.

A side end of a compression coil spring 8, serving as an elastic support member connected between the lever 7 and the vertical plate 10, is horizontally connected to an upper side portion of the lever 7. Also, a spring support 11 has a side portion coupled to another end portion of the compression coil spring 8 and another side portion horizontally connected to an upper side portion of the vertical plate 10.

A stopper support 13 acts as an interruption member and is provided between the lever 7 and the vertical plate 10. An end portion of the stopper support 13 is horizontally connected to a predetermined intermediate portion of the vertical plate 10, and another end portion of the stopper 13 is passed through the insertion hole 7*a* formed in the lever 7.

A stopper 9 is spaced by an interval δ from the lever 7 so as to restrict a horizontal movement of the guide roller 5 to a predetermined displacement, for thereby preventing the guide roller 5 from escaping the guide rail 1 with regard to the stopper support 13. Here, the interval δ is significantly small.

With reference to FIG. 4, the guide roller apparatus according to another example of the background art will now be described.

At each corner of the elevator car 1, a plurality of vertical frames 14 are fixed by bolts and nuts (not shown) to an upper frame 12 and a lower frame 13.

A vertical roller 15 which runs along the guide rail 4 is connected to the vertical frame 14. A pair of horizontal rollers 16 are connected to each other, symmetrically with respect to the vertical roller 15.

A stable pin 19 is inserted into the vertical frame 14 with regard to a roller rotation shaft on which the vertical and horizontal rollers 15, 16 are rotated. An end portion of the stable pin 19 is fixed to another vertical frame (not shown). Onto another end portion of the stable pin 19 a coil spring 20 is fitted one end of the coil spring 20 abuts a compression seat 23 to confine the coil spring 20. A stable nut 24 is connected to a side portion of the compression seat 23 to fix the compression seat 23 thereto.

An end portion of a stopper support 17*a* (communicating with the vertical frame 14 and fixed to another vertical frame (not shown) is connected below the roller rotation shaft 18 so as to prevent the elevator car 1 from shaking excessively. The stopper 17 is spaced by a predetermined interval from the vertical frame 14 and is connected to another end portion of the stopper support 17*a*.

The thusly constituted conventional guide roller apparatus may vibrate horizontally during its operation for a variety of reasons, including poor installation of the guide rail 4, an aged connection member, and varied surface roughness.

Such horizontal vibrations are transferred through the guide roller 5 to the elevator car 1 by the guide rail 4. Here, an exciting force caused by the horizontal vibration is evenly distributed to each of the guide rollers 5 disposed at the respective corners of the elevator car 1, when the guide rail 4 is in good condition, the elevator car 1 is well balanced without tilting to one side thereof, thereby being buffered by the compression coil springs 8, 20 of the guide roller 5.

However, if the guide rail condition is not good and the elevator car is excessively tilted to one side the exciting force applied to the elevator car 1 increases by the unbalance of the elevator car 1, therefore, the lever 7 or the stoppers 9, 17 (spaced by an allowed movement displacement δ from the vertical frame 14) restricts the horizontal movement of the lever 7, the vertical frame 14 and the guide rollers 5.

As shown in FIG. 8, the support force of the guide roller 5 is good in an interval $P_0$–$P_A$ (as shown by line A) and in an interval $P_0$–$P_B$ (as shown by line B), which are supported by the compression coil springs 8, 20. Therefore the exciting force caused by deformations of the guide rails 4 when the elevator car 1 runs along the guide rails 4 in the elevation shaft 3, cause deflection of the coil springs 8, 20 attached to the guide rollers 5.

That is, the vibration sensed by the passengers aboard the elevator car 1 is decreased.

However, the spring constant values K of the coil springs 8, 20 should be decreased so as to improve a vibration buffering effect of the coil springs 8, 20. Therefore when an unbalanced load or an intensive load is charged into the elevator car 1, the elevator car 1 excessively tilts so that an interruption between the elevator car 1 and other devices. At the same time, the guide roller 5 disposed on the elevator car 1 may deviate from the guide rail 4 disposed vertically in the elevation shaft 3, thereby causing a safety problem.

That is, as shown in line A of FIG. 8, when the displacement of a central portion of the guide roller 5 with regard to a supporting force $P_A$ of the coil springs 8, 20 of the guide roller 5 surpasses a value δa, the tough stoppers 9, 17 become operable, thereby dissipating a horizontal vibration of the elevator car 1. Also, when the guide roller 5 travels through between an supporting force interval $P_0$–$P_A$ according to line A in FIG. 8, or an interval less than the displacement δa of the center of the guide roller and the interval which is more than the supporting force $P_A$, (and which displacement at a central portion of the guide roller is more than displacement δa) the variation of an abrupt spring characteristic may deteriorate the vibration of the elevator car.

In order to solve the above-described problem, when coil spring 8 having a large spring constant value K is employed, a poor condition interval $P_A$–$P_B$ as well as a good condition interval $P_0$–$P_A$ may be supported by the coil spring. Here, an exciting force which occurs due to transformations or deformations of the guide rails may be buffered.

However, when the guide rails are in good condition, the constant value K of the coil spring becomes increased, thereby generating a poor vibration characteristic.

SUMMARY OF THE INVENTION

Accordingly, it is an object of the present invention to provide a guide roller apparatus for an elevator system for preventing horizontal vibration of an elevator car, thereby providing comfortable ride aboard the elevator car.

To achieve the above-described object, a guide roller apparatus for an elevator system, includes a flat frame fixed to each corner of an elevator car, a lever having a lower portion hingedly connected to an upper portion of the flat frame and upper portion rotatably connected to a roller shaft of the guide roller, and an insertion hole formed through a mid portion of the lever. A vertical plate is connected to an end portion of the frame and faces the lever, an elastic support is horizontally connected between an upper portion of the lever and an upper portion of the vertical plate. A control means, has an end portion connected to a mid inner portion of the vertical plate, and another end portion inserted through the insertion hole formed in the lever. An elastic medium means is disposed on the control means between the vertical plate and the lever.

Further, to achieve the above-described object, a guide roller apparatus for an elevator system, of guide rails vertically disposed along walls in an elevation shaft, and a plurality, lower and upper frames fixed by bolts and nuts to a plurality of vertical frames provided at each corner of the elevator car, a plurality of rollers engaged to the vertical frames and each engagable with a guide rail, a stopper support bar engaged with a lower portion of the vertical frame (the lower portion of the vertical frame disposed below a roller rotation shaft connecting the rollers and the vertical frame), a stopper disposed on the stopper support bar and spaced from the vertical frame, and a stable pin-engaged into an upper portion of the vertical frame (the upper portion of the vertical frame disposed above the roller rotation shaft connecting the rollers and the vertical frame. A stable nut is engaged with an end portion of the stable pin, and an elastic support means is disposed between the stable nut and the vertical frame and includes a vibration buffer means formed of rubber.

The object and advantages of the present invention will become more readily apparent from the detailed description given hereinafter. However, it should be understood that the detailed description and specific example, while indicating a preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

With reference to the accompanying drawings, the guide roller apparatus for an elevator system will now be described.

Figure 1:
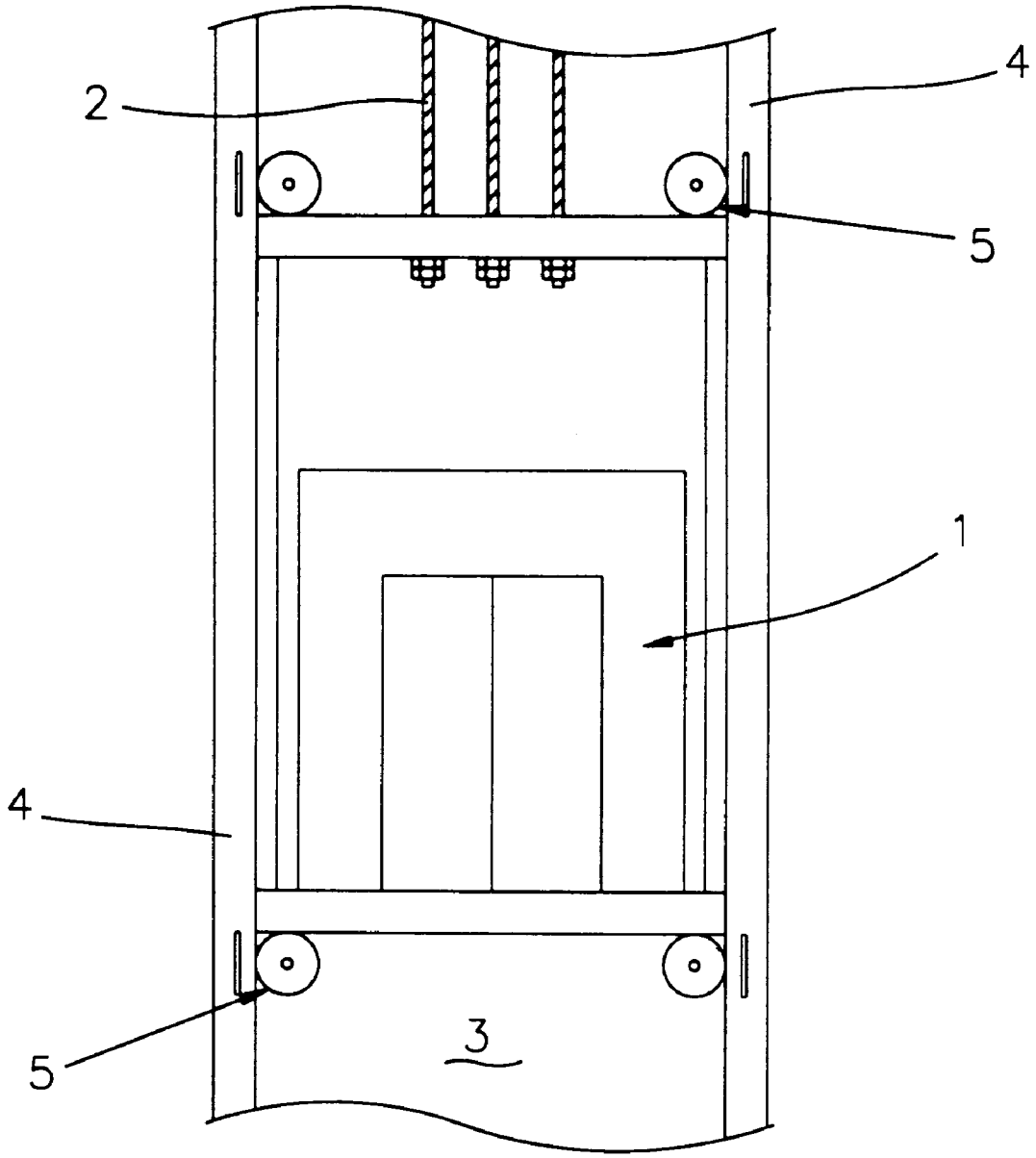
FIG. 1 CONVENTIONAL ART
FIG. 1 is a schematic front view illustrating a general elevator system.
Figure 2A:
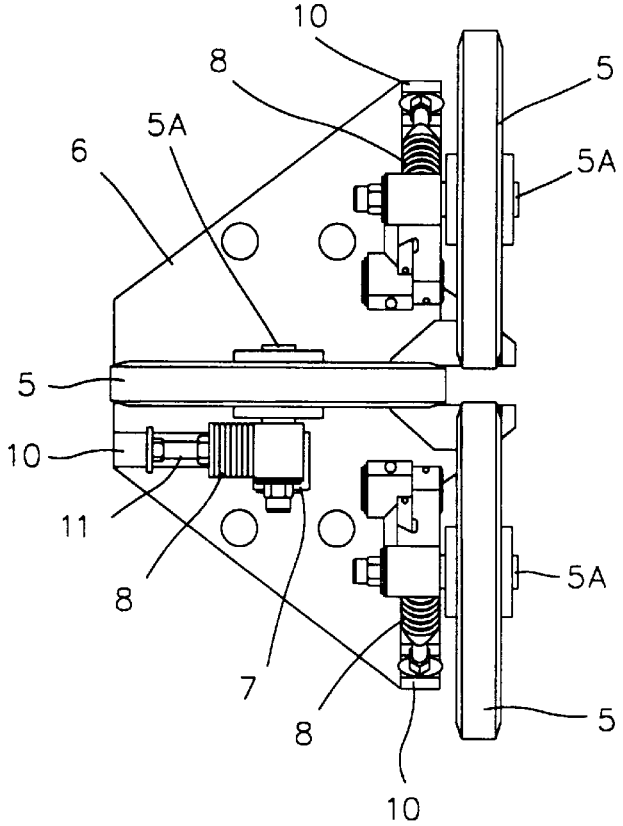
FIG. 2A CONVENTIONAL ART
FIG. 2A is a plan view illustrating an example of a guide roller apparatus for an elevator system according to a conventional art.
Figure 2B:
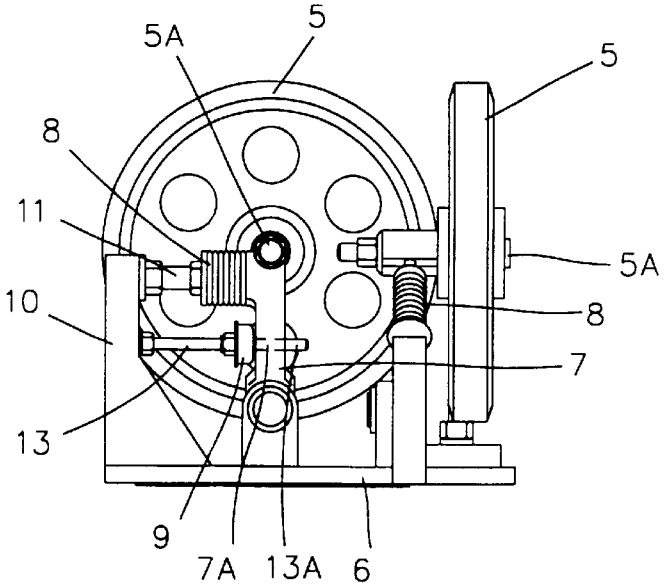
FIG. 2B CONVENTIONAL ART
FIG. 2B is a front view illustrating an example of a guide roller apparatus for an elevator system according to the conventional art.
Figure 3:
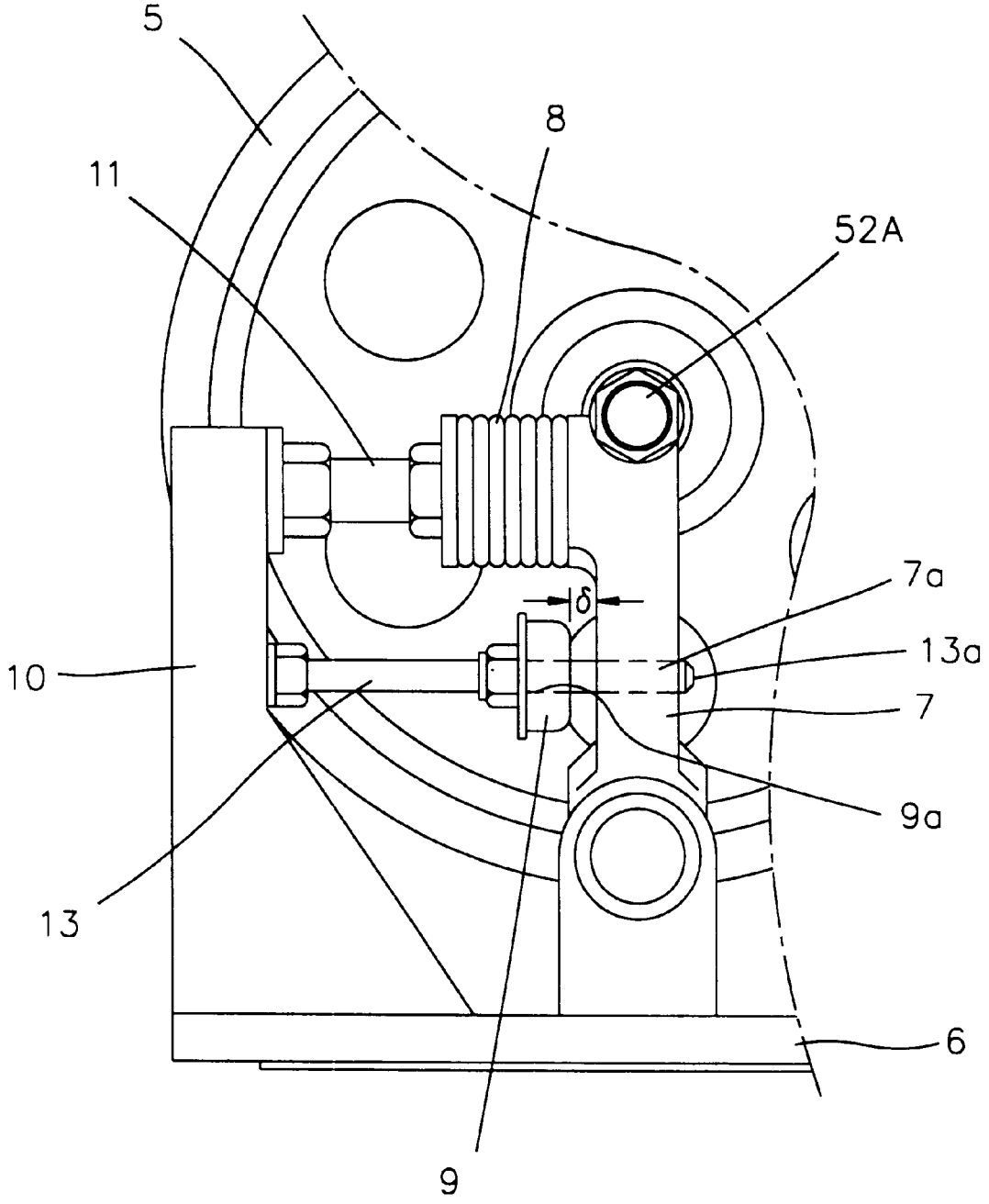
FIG. 3 CONVENTIONAL ART
FIG. 3 is a partial enlargement view illustrating the guide roller apparatus for an elevator system according to the conventional art.
Figure 4:
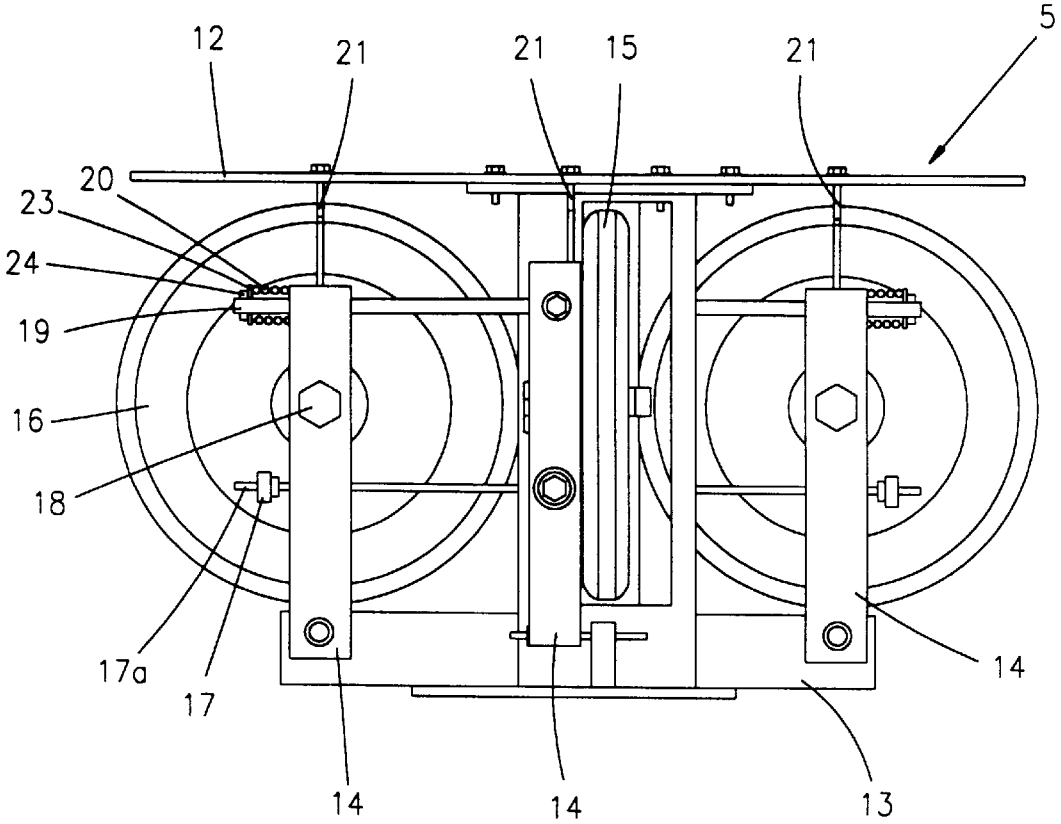
FIG. 4 CONVENTIONAL ART
FIG. 4 is a front view illustrating another example of a guide roller apparatus for an elevator system according to the conventional art.
Figure 5:
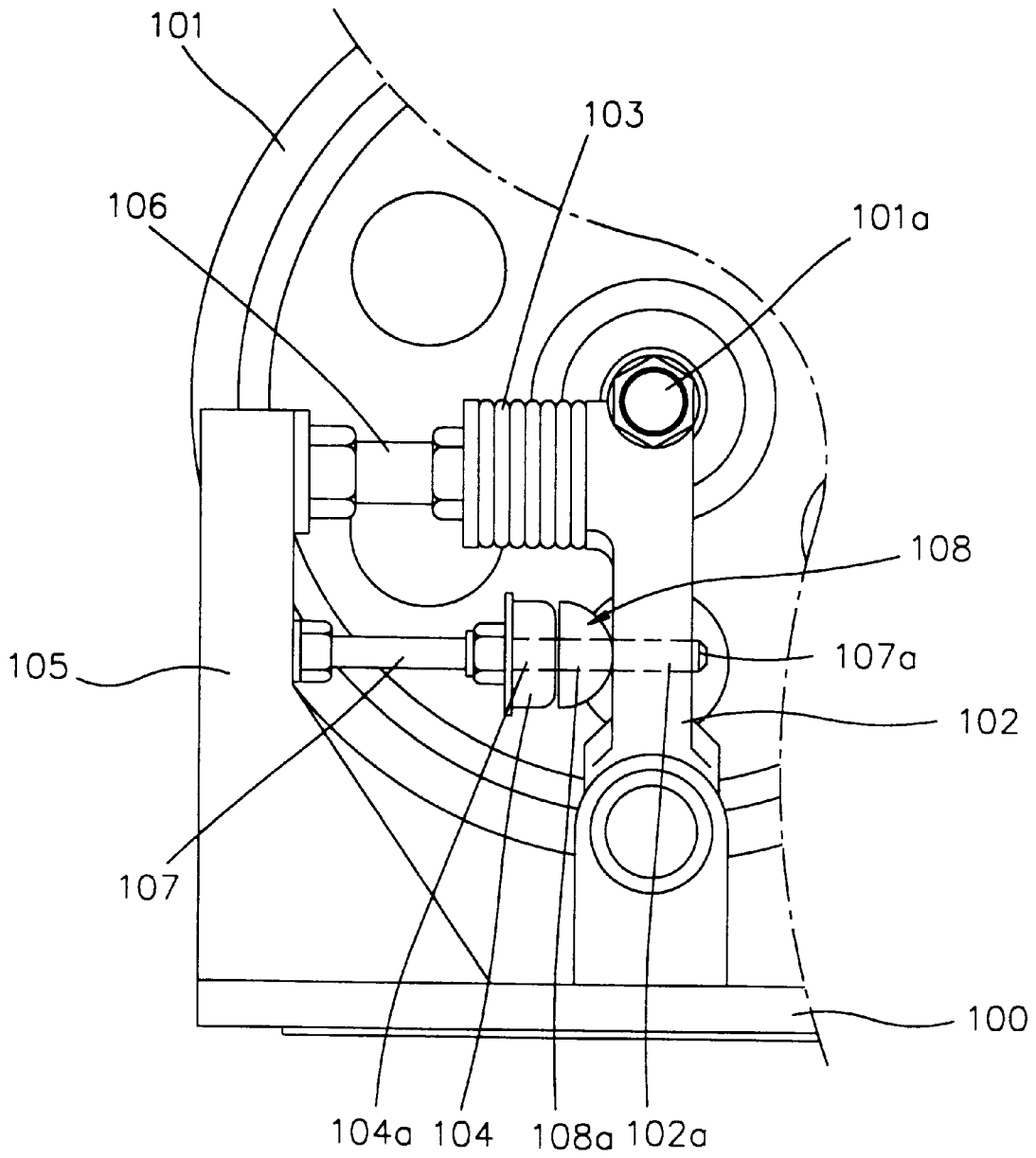
FIG. 5 is a partial enlargement view illustrating the guide roller apparatus for an elevator system according to a first embodiment of the present invention.

As shown in FIG. 5, the guide roller apparatus for an elevator system according to the first embodiment of the present invention, includes a lever 102 having a lower portion hingedly engaged to a flat type frame 100 fixed to each corner of an elevator car (not shown), and an upper portion connected to a rotation shaft 101*a* of the guide roller 101, thereby rotatably supporting the guide roller 101 on the rotation shaft 101 in at the frame 100. Here, an insertion hole 102*a* is formed at a lower portion of the lever 102.

A side end portion of the frame 100 is engaged with a vertical plate 105 facing the lever 102 and having a predetermined height.

Between the lever 102 and the vertical plate 105 there are provided a coil spring 103 having an end portion horizontally connected to an upper portion of the lever 102, and or elastic spring support member 106 member which is provided between an upper side portion of the vertical plate 105 and the spring support 106.

A stopper support bar 107 is horizontally connected to a mid portion of the vertical plate 105 and is inserted through an insertion hole 102*a* formed in the lever 102 so as to be horizontally movable.

The stopper 104 restrains a horizontal movement of the guide roller 101 within a predetermined displacement so as to prevent a deviation of the guide roller 101 from the guide rail (not shown). The stopper 104 is provided on the stopper support bar 107, and an elastic member 108 is provided between the stopper 104 and the lever 102.

A flat side of the elastic member 108 is connected to the stopper 104, and a rounded portion of the elastic member 108 is abutted to the lever 102.

The stopper 104 and the elastic member 108 respectively include insertion holes 104*a*, 108*a* in order for the stopper support bar 107 to pass therethrough.

Here, the elastic member 108 is formed of a magnetic spring or a rubber.

A portion of the elastic member 108 which abuts to the lever 102 is rounded in shape to accurately support the lever 102 without regard to a back and forth reciprocal movement of the lever 102.

The operation of the guide roller apparatus for an elevator system according to the first embodiment of the present invention will now be explained.

First, an exciting force generated due to transformations or deformations of the guide rail (not shown) is transferred to the guide roller 101 and displaces the lever 102 supporting the guide roller 101.

The thusly generated displacement of the lever 102 deflects the coil spring 103 which elastically supports the lever 102 while reciprocating in the direction of the guide rail (not shown).

Figure 8:
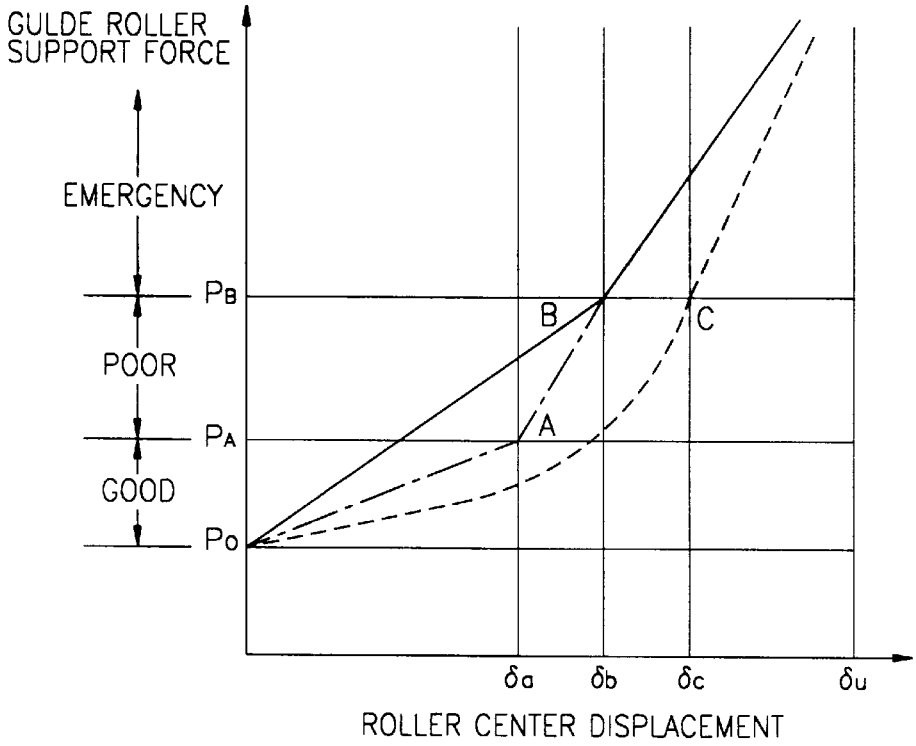
FIG. 8 is a graph illustrating an elastic characteristic with regard to a relation between supporting force and displacement according to the first embodiment of the present invention.

The spring characteristic of the coil spring 103 approximates curve C in FIG. 8, whereby the coil spring 103 and the elastic member 108 provided between the stopper 104 and the lever 102 manipulate the reciprocal movement of the lever 102.

In accordance with the operation of the elastic member 108, a characteristic difference between the coil spring 103 and the stopper 104 having a larger spring constant value decreases.

That is, when the lever 102 deviates outside of a predetermined displacement range due to an exciting force in an interval supported by only the coil spring 103, the lever 102 comes to abut to the stopper 104 having a high spring constant value and having a tough formation. The characteristic difference occurring at this time between the coil spring 103 and the stopper 104 is decreased by the elastic member 108 serving as an elastic medium member inserted between the spring 103 and the stopper 104.

Therefore, the exciting force which occurs due to transformations or deformations of the guide rail (not shown) is transferred to the guide roller 101, and a displacement value of the guide roller 101 with regard to the exciting force softly reciprocates between an interval of $P_0$–$P_A$ which is supported only by the coil spring 103 and another interval of more than $P_B$ which is supported by the stopper 104, as shown in FIG. 8. Accordingly, when the elevator car (not shown) is excessively tilted and an excessive force is applied on the guide roller 101, or when an emergency situation such as an earthquake occurs, the displacement with regard to the exciting force affects the coil spring 103, the stopper 104 and the elastic member 108 serving as an elastic medium member.

That is, as shown in FIG. 8, the generated exciting force is transferred to the guide roller 101, and the displacement of the guide roller 101 with regard to the exciting force is transferred to the lever 102.

At an initial displacement, the guide rail (not shown) is in good condition and the elevator car is not tilted to a side, so that the guide roller 101 for the balanced elevator car is driven in an interval of supporting force $P_0$–$P_A$ in which the guide roller 101 is supported only by the coil spring 103.

In an interval which is supported by the coil spring 103, the coil spring 103 and the elastic member 108 act in common against the displacement of the guide rail 101.

At this time; the action of the elastic member is not strong, and the action of the coil spring 103 is dominant, whereby the vibration characteristic of the elevator maintains a good condition.

However, under a poor condition in which the guide rail (not shown) is in a poor condition, and the elevator car (not shown) is not well balanced, the guide roller 101 reciprocates between an interval of supporting force $P_0$–$P_A$ in which the guide roller 101 is supported only by the coil spring 103 and another interval of more than $P_B$ which is supported by the stopper 104.

Here, the supporting force is shared by the coil spring 103, the stopper 104 and the elastic member 108 with regard to the displacement of the guide roller 101, thereby minimizing a spring characteristic difference.

When the stopper 104 acts on the lever 102 in accordance with the exciting force, the elastic member 108 operates against the displacement caused by the transformation of the guide rail (not shown) when the elastic member 108 is abutted to the lever 102. Therefore, when the guide roller 101 reciprocates between an interval of supporting force $P_0$–$P_A$ in which the guide roller 101 is supported only by the coil spring 103 and another interval of more than $P_B$ which is supported by the stopper 104, a soft curve C in FIG. 8 may be obtained without a sudden variation of the spring characteristic, thereby securing a good variation characteristic under any of the driving conditions with regard to the elevator vibration.

The guide roller apparatus for an elevator system according to the second embodiment of the present invention will now be described.

Figure 6:
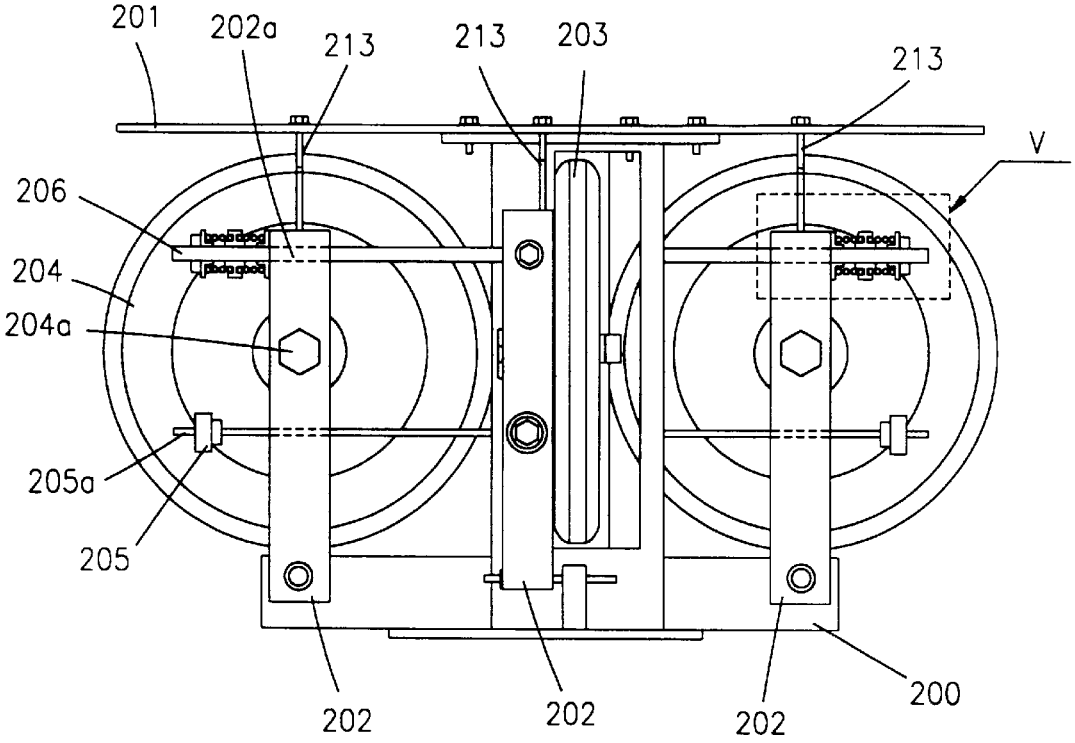
FIG. 6 is a front view illustrating the guide roller apparatus for an elevator system according to a second embodiment of the present invention.

As shown in FIG. 6, the guide roller apparatus according to the second embodiment of the present invention includes a lower frame 200 and an upper frame 201 which are fixed by bolts (not shown) and nuts (not shown) to a plurality of vertical frames 202 provided at each corner of an elevator car (not shown).

A vertical roller 203 guided by a guide rail (not shown) and a pair of horizontal rollers 204 disposed symmetrically relative to the vertical roller 203 are connected to the vertical frame 202.

With reference to a rotation shaft 204*a* on which the vertical roller 203 and the horizontal roller 204 are rotated, a stopper 205 for preventing excessive vibration of the elevator car is disposed below the vertical frame 102 at the stopper support bar 205*a*.

A fluctuation hole 202*a* is formed through an upper portion of the vertical frame 202 relative to the roller rotation shaft 204*a*, and a stable pin 206 passed through the fluctuation hole 202*a* is connected through an elastic member provided with a buffer material such as rubber so as to decrease a horizontal vibration of the elevator car (not shown). An end portion of the stable pin 206 is fixed to the vertical frame 202. A nut 210 for fixing the elastic member is engaged to an end portion of the stable pin 206.

Figure 7:
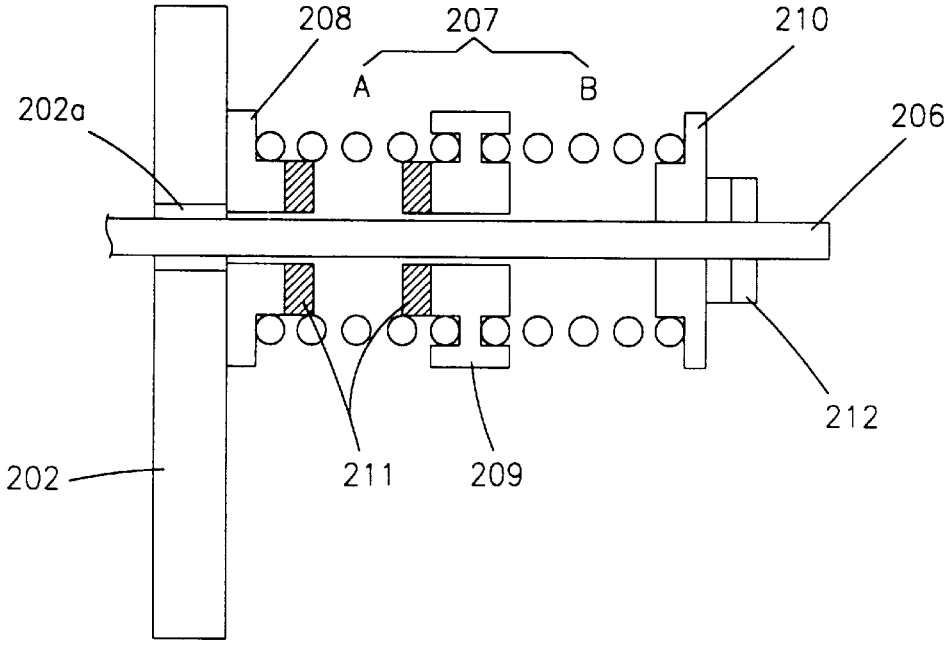
FIG. 7 is a schematic plan view enlarging a portion V in FIG. 6.

Referring to FIG. 7, the elastic member will now be described.

First, the stable pin 206 serving as a support member is passed through the fluctuation hole 202*a* formed in the vertical frame 202, and a stable nut 212 is engaged to an end portion of the stable pin 206.

A compression limit seat 208 formed of a spring material is connected to an end portion of the vertical frame 202 having the stable pin 206 passing therethrough, and a compression seat 210 is engaged to a distal end portion of the stable nut 212 engaged to the end portion of the stable pin 206.

Also, a plurality of springs 207 having different spring constant values are disposed between the compression limit seat 208 and the compression seat 210, and a connection seat 209 is provided between the respective coil springs 207.

A rubber packing 211 is attached on facing inner side surfaces of the compression limit seat 208 and the spring connection seat 209. Here, reference numeral 213 denotes a friction damper.

The operation of the guide roller apparatus for an elevator system according to the second embodiment of the present invention will now be described.

First, respective spring constant values of the two compression coil springs 207 serially disposed on the stable pin 206 are obtained as follows:

$$\frac{1}{K} = \frac{1}{K_A} + \frac{1}{K_B} \text{ or } K = \frac{K_A \times K_B}{K_A + K_B}$$

wherein, K denotes an equivalent spring constant value, $K_A$ is a constant value of spring A, and $K_B$ is a constant value of spring B.

When the springs A, B having such an equivalent spring constant value K are more than an initial displacement limit, the spring A is compressed and at the same time the rubber packings 211 formed on the respective inner surfaces of the compression limit seat 208 and the connection seat 209 abut other. Then, when the spring A is compressed to a predetermined extent, only the spring B is compressed thereafter, wherein the spring constant value becomes $K_B$.

Figure 9:
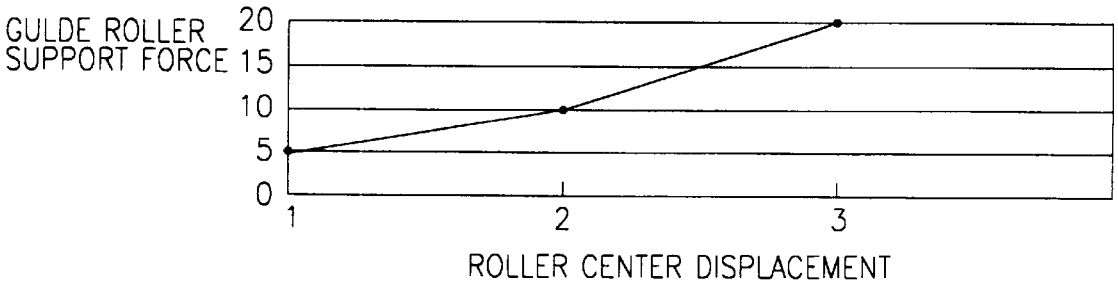
FIG. 9 is a graph illustrating an elastic characteristic with regard to a relation between supporting force and displacement according to the first embodiment of the present invention.

The initial displacement limits of the respective springs A, B are controlled by the stable nut 212 which fixes the compression seat 210 attached on the stable pin 206. At this time, the variations of the spring constant values $K_A$, $K_B$ are as shown in the graph of FIG. 9, wherein the slope of the graph denotes a spring constant value.

That is, a characteristic difference between the spring A and the spring B (each provided with different spring constant values) is minimized by the rubber packings 211 attached to the respective inner sides of the compression limit seat 208 and the connection seat 209, to thereby provide a satisfactory vibration characteristic.

As described above, the guide roller apparatus for an elevator system according to the present invention employs an elastic medium member and significantly decreases a horizontal vibration of an elevator car, thereby leading passengers aboard the elevator car to feel comfortable without shaky disturbance.

As the present invention may be embodied in several forms without departing from the spirit of essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within meets and bounds of the claims, or equivalences of such meets and bounds are therefore intended to embrace the appended claims.

What is claimed is:

1. A guide roller assembly for an elevator car used in an elevator system, comprising:

a frame adapted to be attached to an elevator car;

a lever member having a lower portion fixed to said frame and an upper portion pivotably attached to said lower portion, said upper portion having an insertion hole formed therethrough;

a guide roller rotatably mounted on said upper portion of said lever member;

a vertical support mounted on said frame;

an elastic support connecting a portion of said vertical support and said upper portion of said lever member;

a control rod having one end thereof fixed to said vertical support and a second end thereof received in said insertion hole;

a stopper member mounted on said control rod intermediate said upper portion of said lever member and said vertical support; and an elastic member mounted on said control rod intermediate said upper portion of said lever member and said stopper member, wherein said elastic member has a rounded surface opposite said lever member, and a substantially flat surface opposite said stopper member.

2. The assembly according to claim 1, wherein said elastic member is made from rubber.

3. A guide roller assembly for an elevator car used in an elevator system, comprising:

a framework comprising a plurality of vertical frame members fixed to upper and lower frame members;

a guide roller rotatably mounted on one of said vertical frame members on a rotation shaft;

a stopper support bar extending between first respective said vertical frame members;

a stopper mounted on said stopper support bar, spaced away from a respective said vertical frame member;

a stable pin extending between second respective said vertical frame members;

a stable nut fixed onto said stable pin; and an elastic support structure disposed intermediate said stable nut and one of said second respective vertical frame members, said elastic support structure including:

first and second coil springs wound about said stable pin;

a connection seat mounted on said stable pin between said first and second coil springs; and first and second spring seats mounted on said stable pin at respective ends of said first and second coil springs distal to said connection seat.

4. The assembly according to claim 3, wherein one of said first and second spring seats and said connection seat include opposing resilient portions which selectively abut each other in accordance with a compression of a corresponding said first or second coil spring.

* * * * *